United States Patent [19]

Trace et al.

[11] 4,192,844

[45] Mar. 11, 1980

[54] METHOXYPROPYLAMINE AND HYDRAZINE STEAM CONDENSATE CORROSION INHIBITOR COMPOSITIONS AND METHODS

[75] Inventors: William L. Trace, Pittsburgh; Jerry L. Walker, Coraopolis, both of Pa.

[73] Assignee: Calgon Corporation, Pittsburgh, Pa.

[21] Appl. No.: 936,294

[22] Filed: Aug. 23, 1978

Related U.S. Application Data

[63] Continuation-in-part of Ser. No. 908,334, May 22, 1978, abandoned, which is a continuation-in-part of Ser. No. 859,342, Dec. 12, 1977, abandoned.

[51] Int. Cl.[2] ..... C23F 11/02; C23F 11/04; C23F 11/14

[52] U.S. Cl. ..... 422/11; 252/392; 422/12; 422/16

[58] Field of Search ..... 21/2.5 B, 2.5 R, 2.7 R; 203/7; 252/392; 422/11, 16, 12

[56] References Cited

U.S. PATENT DOCUMENTS

| | | | |
|---|---|---|---|
| 2,582,138 | 1/1952 | Lane et al. | 21/2.5 B UX |
| 3,029,125 | 4/1962 | Hummel | 21/2.5 B UX |
| 3,447,891 | 6/1969 | Crawford | 21/2.5 B X |
| 3,551,349 | 12/1970 | Kallfass | 21/2.5 B UX |
| 3,649,167 | 3/1972 | Sawyer | 21/2.7 R X |
| 3,785,988 | 1/1974 | Yamashita et al. | 21/2.7 R X |
| 3,808,138 | 4/1974 | Yamaguchi et al. | 21/2.7 R X |
| 3,843,547 | 10/1974 | Kaufman et al. | 21/2.7 R X |
| 4,062,764 | 12/1977 | White et al. | 21/2.5 B X |

OTHER PUBLICATIONS

Work Chemicals Co., Surfam P5A Product Bulletin, Atlanta, Ga.

*Primary Examiner*—Barry S. Richman

*Attorney, Agent, or Firm*—Mario A. Monaco; Martin L. Katz

[57] ABSTRACT

Use of methoxypropylamine as a neutralizing amine in combination with hydrazine to prevent corrosion in steam condensate systems or in other low solids aqueous systems.

4 Claims, No Drawings

METHOXYPROPYLAMINE AND HYDRAZINE STEAM CONDENSATE CORROSION INHIBITOR COMPOSITIONS AND METHODS

This application is a continuation-in-part of U.S. Ser. No. 908,334, filed May 22, 1978 and now abandoned, which is a continuation-in-part of U.S. Ser. No. 859,342, filed Dec. 12, 1977, which is now abandoned.

BACKGROUND OF THE INVENTION

This invention relates to corrosion control in steam condensate systems and other aqueous systems in which the mineral content is relatively low.

More particularly, this invention relates to the use of methoxypropylamine in combination with hydrazine to control corrosion in steam condensate systems or in other low solids aqueous systems.

Condensate corrosion protection is becoming an increasingly important aspect of plant operation. In these energy-concious times, an increase in the quantity and quality of condensate will result in water and heat savings for the total boiler system.

Historically, the action of dissolved gases such as oxygen and carbon dioxide have been two of the main factors that lead to condensate corrosion. In order to understand the role of oxygen and carbon dioxide in corrosion, one must understand the electrochemical nature of corrosion. Pure water has very little effect on pure iron, but this situation is seldom encountered. Under most conditions, there is a tendency for iron to dissolve in water, and two electrons are released for each atom that dissolves. These electrons are transferred to hydrogen ions present in water, and the ions are reduced to elemental gaseous hydrogen. All action ceases at this point if the hydrogen remains on the surface of the metal since a protective coating is formed that interfers with the passage of electrons. However, any agent which increases the number of hydrogen ions present in the water, or which will cause the removal of the protective film, serves to increase the rate of corrosion.

When carbon dioxide dissolves, it reacts with water to form carbonic acid, which supplies additional active hydrogen to the system. Iron displaces the hydrogen from this acid. When oxygen is also present in the water, a two-fold reaction takes place. Some molecules of oxygen combine with the displaced hydrogen and thus exposes the metal to fresh attack. Other oxygen molecules combine with iron ions to form insoluble rust compounds.

A greater corroding influence than the mere dissolving tendency of iron is the existence of a heterogeneous surface in commercial iron and steel due to the presence of surface imperfections which tend to form couples with the adjacent base metal. Electrons are released from the anodes of these couples to the hydrogen ions at the adjacent cathodic surface, thus increasing the corroding area and accelerating the rate of corrosion.

The first product of corrosion may be converted of ferric oxide, which is only loosely adherent and aggravates corrosion by blocking off areas to oxygen access. These areas become anodic and iron oxide couples are set up. The iron under the oxide deposit then dissolves, and pitting develops. Carbon dioxide attack results in thinning or grooving of the metal.

For those systems that will permit it, filming amines will give condensate corrosion protection against both oxygen and carbon dioxide. However, many industrial systems cannot tolerate filming amines and must use neutralizing amines.

The ideal neutralizing amine should have the following characteristics:

1. The distribution ratio should be high enough so that a considerable amount of the neutralizing amine fed to the boiler will end up in the condensate. This will reduce the loss of neutralizing amine via blowdown.

2. The distribution ratio should not be too high in order to keep losses due to aeration and venting to a minimum. The distribution ratio is the ratio of the amount of amine in the vapor phase to that in the liquid phase.

3. The basicity value should be moderately high or very high so that the amine will efficiently neutralize all carbon dioxide that it encounters.

4. The neutralizing amine should have sufficient hydrolytic-thermal stability so that it will not break down to ammonia and other compounds in the boiler or in superheated or saturated steam.

5. The neutralizing amine should be a water-soluble liquid for feeding convenience.

Neutralizing amines such as cyclohexylamine and morpholine have been used but they have several disadvantages. For example, cyclohexylamine has a high distribution ratio and accordingly, substantial cyclohexylamine escapes the system through the deaerator vent. Morpholine, on the other hand, has a low basicity value which means that more morpholine is required to attain high pH's in the condensate system and it also has a very low distribution ratio which means that substantial amounts are lost via blowdown.

SUMMARY OF THE INVENTION

The neutralizing amine of this invention overcomes the above-mentioned disadvantages of cyclohexylamine and morpholine. Methoxypropylamine has a very desirable distribution ratio and a fairly high basicity value.

Methoxypropylamine may be used alone or in combination with an oxygen corrosion inhibitor such as hydrazine. In use, concentrations of 0.1 to 1000 mg/l, and preferably 1 to 100 mg/l, should be maintained in the steam condensate system. When used in combination with hydrazine or another oxygen corrosion inhibitor, the compositions should contain on an active basis from about 1% to about 99% methoxypropylamine and from about 0.1% to about 50%, preferably about 1% to about 15%, of the oxygen corrosion inhibitor. The compositions of this invention may be fed to the steam condensate system being treated by conventional liquid feeding means or may be fed to the boiler feedwater or directly to the steam supply lines.

The following examples will illustrate the use of methoxypropylamine, alone and in combination with hydrazine, as a steam condensate corrosion inhibitor in accordance with the teachings of this invention.

EXAMPLE 1

Distribution ratios of a number of neutralizing amines were calculated by preparing solutions of each amine having a concentration of 100 mg/l and adding 500 ml of this solution to a brine pot which is slowly and uniformly heated so that 100 ml of distillate is produced every 40 minutes. Additional solution is manually introduced to the brine pot every 5 to 10 minutes to maintain the brine pot solution at the 500 ml mark. Each 100 ml aliquot of distillate is collected and pH determined until constant pH is attained for three successive aliquots. This is taken to represent the establishment of equilibrium conditions. At equilibrium, the brine and the final 100 mls are analyzed by gas chromatography to determine the amount of amine in each and the Distribution Ratio (D.R.) calculated by the following formula:

$$D.R. = \frac{\text{Amine Concentration in Final 100 mls}}{\text{Amine Concentration in Brine}}$$

Similarly, the basicity value ($K_b$) or measure of the amine's ability to react with carbon dioxide is calculated in accordance with the formula:

$$K_b = \frac{[BH^+]\,[OH^-]}{[B^\circ]}$$

wherein $[BH^+]$, $[OH^-]$ and $[B^\circ]$ are defined as:

$[BH^+]$=concentration of dissociated amine $[OH^-]$=hydroxide concentration $[B^\circ]$=concentration of free, undissociated amine The results of these tests and calculations are set forth in Table I.

Table I

| | Amine Properties | | |
|---|---|---|---|
| | Molecular Weight | $K_b$ | Distribution Ratio |
| Cyclohexylamine | 99 | $153 \times 10^{-6}$ | 3.8 |
| Morpholine | 87 | $2.4 \times 10^{-6}$ | 0.4 |
| Diethylamino-ethanol | 117 | $52 \times 10^{-6}$ | 2.7 |
| 2-amino,2-methyl-propanol | 89 | $40 \times 10^{-6}$ | 0.3 |
| Methoxypropyl-amine | 89 | $130 \times 10^{-6}$ | 1.0 |
| Hydrazine | 32 | $1.7 \times 10^{-6}$ | — |

EXAMPLE 2

The hydrolytic-thermal stability of various neutralizing amines is measured by a test in which the neutralizing amine at a concentration of 1000 mg/l is autoclaved for 24 hours at 600 psi (489° F.) and the final concentration of ammonia measured. The results of this test are set forth in Table II.

Table II

| Amine | mg/l $NH_3$ |
|---|---|
| Methoxypropylamine | <1.0 |
| Morpholine | 1.6 |
| Cyclohexylamine | 3.3 |
| Diethylaminoethanol* | 2.4 |
| Aminomethylpropanol | 124.0 |

*Diethylaminoethanol breaks down appreciably to diethylamine.

EXAMPLE 3

A condensate test system is used to evaluate neutralizing amines. This system comprises a boiler capable of producing 45 kilograms/hour of a steam at pressure of 200 psi, pumps and metering devices to control the composition of the make-up water to the boiler, and cooling coils with temperature control means to condense the steam. The condensate is recirculated through a test loop where metal coupons and corrosometer probes evaluate the corrosion rate. The test water is distilled water containing <1 mg/l $SO_4$, <1 mg/l Cl, <1 mg/l $SiO_2$ and 10 mg/l $CO_2$. Table III sets forth the results of corrosion tests in this system.

Table III

| Inhibitor | pH | Concen-tration | Corrosion Rate % Reduction from Control |
|---|---|---|---|
| Control | — | 0 | 0% |
| Cyclohexylamine | 8.5 | 37.5 mg/l | 48% |
| Morpholine | 8.5 | 152 mg/l | 73% |
| Methoxypropylamine | 8.5 | 106 mg/l | 75% |

EXAMPLE 4

The condensate test system of EXAMPLE 3 was used to demonstrate the effect of the addition of hydrazine to methoxypropylamine in the inhibition of corrosion.

Table IV

| Inhibitor | pH | Amount of Inhibition In System | Inhibition | Inhibition per ppm of Available Product |
|---|---|---|---|---|
| Control | — | — | 0% | 0.00% |
| MPA | 8.5 | 106 ppm | 75% | 0.71% |
| 7% Hydrazine/ 93% MPA | 8.5 | 61 ppm | 83% | 1.36% |
| 15% Hydrazine/ 85% MPA | 8.5 | 61 ppm | 71% | 1.16% |
| Hydrazine | 8.5 | 22 ppm | 19% | 0.86% |
| 1% Hydrazine/ 99% MPA | 8.5 | 49.5 ppm | 55% | 1.11% |

*MPA = Methoxypropylamine

We claim:

1. A steam condensate corrosion inhibiting composition consisting essentially of methoxypropylamine and from 1 to 15% by weight hydrazine.

2. A steam condensate corrosion inhibiting composition as in claim 1 which contains approximately 7 percent by weight hydrazine.

3. A method of inhibiting corrosion in steam condensate systems which comprises maintaining in said systems an effective amount of a composition consisting essentially of methoxypropylamine and from 1 to 15% by weight hydrazine.

4. A method of inhibiting corrosion in steam condensate systems as in claim 3 wherein a concentration of at least 1.0 mg/l of said composition is maintained.

* * * * *